US006746010B2

(12) United States Patent
Ozaki

(10) Patent No.: US 6,746,010 B2
(45) Date of Patent: Jun. 8, 2004

(54) APPARATUS FOR CONVEYING SHEET-LIKE RECORDING MATERIAL

(75) Inventor: Takao Ozaki, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 102 days.

(21) Appl. No.: 10/232,522

(22) Filed: Sep. 3, 2002

(65) Prior Publication Data

US 2003/0057640 A1 Mar. 27, 2003

(30) Foreign Application Priority Data

Sep. 4, 2001 (JP) ..... 2001-267766

(51) Int. Cl.[7] ..... B65H 29/54; B65H 5/02; B65H 5/22; B65H 83/00; B65H 85/00

(52) U.S. Cl. ..... 271/3.21; 271/3.24; 271/277; 271/308; 271/902

(58) Field of Search ..... 271/3.21, 3.24, 271/275, 277, 308, 902; B65H 29/54, 5/02, 5/22, 83/00, 85/00

(56) References Cited

U.S. PATENT DOCUMENTS 3,806,114 A * 4/1974 Carter ..... 271/20
5,455,604 A * 10/1995 Adams et al. ..... 346/138
6,561,510 B2 * 5/2003 Ozaki ..... 271/276

* cited by examiner

*Primary Examiner*—Donald P. Walsh
*Assistant Examiner*—Kenneth W. Bower
(74) *Attorney, Agent, or Firm*—Sughrue Mion, PLLC

(57) ABSTRACT

An apparatus for conveying a sheet-like recording material is provided. The conveying apparatus includes a recording material feeding device for feeding the sheet-like recording material to a rotating drum from a feeding guide disposed in a direction tangential to the drum; and a recording material ejecting device for ejecting the recording material from the drum to an ejecting guide disposed in a direction tangential to the rotating drum. The feeding guide and the ejecting guide of the conveying apparatus are disposed near to each other in a thickness direction thereof, and the drum is in the same rotational position at the commencement of feeding the recording material to the drum and when the ejection of the recording material from the drum is completed.

18 Claims, 6 Drawing Sheets

30
28
32
18
31
36
22
20
31A
12
26
16
12 STANDING BY

APPARATUS FOR CONVEYING SHEET-LIKE RECORDING MATERIAL

BACKGROUND OF THE INVENTION

1. Field of the Invention

The present invention relates to an apparatus for conveying a sheet-like recording material, which includes a recording material feeding device for feeding the sheet-like recording material to a drum from a feeding guide disposed along a direction tangential to the drum, and a recording material ejecting device for sending the recording material, which has been fed from the recording material feeding device, from the drum to an ejecting guide disposed along the direction tangential to the drum.

2. Description of the Related Art

Technology has been developed in which, using a sheet-like recording material, and particularly a printing plate precursor including a photosensitive layer formed on a substrate, an image is recorded directly with a laser beam or the like on the photosensitive layer (an emulsion surface) of the printing plate precursor (printing plate exposure apparatuses). With such technology, images can be rapidly recorded on printing plate precursors.

In an automatic printing plate exposure apparatus using such technology for recording an image onto a printing plate precursor, the printing plate precursor is fed from a plate-like feeding guide to a drum in an exposure section, and the printing plate precursor is received by the exposure section, and is registered at a predetermined position and is exposed.

When the exposure is completed, the printing plate precursor is sent from the drum to the plate-like ejecting guide, and is then conveyed for further processing to, for example, a developing apparatus.

For this type of printing plate exposure apparatus, various attempts have been made to improve work efficiency in feeding and ejecting the printing plate precursor to and from the exposure section.

In a first prior art, the feeding guide and the ejecting guide are disposed near to each other in their thickness direction. When feeding a printing plate precursor, the printing plate precursor is fed from the feeding guide to a drum with a leading edge chuck detachably attached on the drum, being positioned on an extension line from the feeding guide. Then, a leading edge of the printing plate precursor is held by the leading edge chuck with a squeeze roller closely contacting the printing plate precursor to the drum. After the printing plate precursor is wound around the drum, trailing edge of the printing plate precursor is held by a trailing edge chuck. At the time of ejecting the printing plate precursor, the trailing edge of the printing plate precursor is released from the trailing edge chuck and the drum is rotated in a reverse direction. When the leading edge chuck reaches a position on an extension line of the ejecting guide, the leading edge of the printing plate precursor is released from the leading edge chuck.

In the first prior art, the position at which the leading edge chuck holds the leading edge and the position at which the leading edge chuck releases the leading edge are different. Therefore, after the previous printing plate precursor has been ejected, the drum must be moved and be registered to a printing plate precursor feeding position to receive and hold the next printing plate precursor.

In a second prior art, a feeding device for feeding a printing plate precursor and an ejecting device for ejecting a printing plate precursor are provided at completely different positions on a drum (for example, at positions 180° apart from each other).

The second prior art includes many components, and the structure is complicated.

In a third prior art, one guide is used for feeding and ejecting a printing plate precursor. Therefore, a position at which the printing plate precursor is held by a leading edge chuck and a trailing edge chuck and a position at which the printing plate precursor is released from the leading edge chuck and the trailing edge chuck are the same.

However, in the third prior art, since the path to feed and eject the printing plate precursor is the same, it is unable to make the next printing plate precursor to stand by at a position near the drum. Therefore, work efficiency is significantly lowered.

SUMMARY OF THE INVENTION

In view of the aforementioned, an object of the present invention is to improve work efficiency by providing an apparatus for conveying a sheet-like recording material which restricts the number of components and reduces the complexity of the apparatus structure, and also by shortening the time required to start feeding the next recording material after finishing ejecting the previous recording material.

A first aspect of the invention is an apparatus for conveying a sheet-like recording material, comprising: a feeding device for feeding the sheet-like recording material to a rotating drum from a feeding guide disposed in a direction tangential to the drum; and an ejecting device for ejecting the recording material fed by the feeding device from the drum to an ejecting guide disposed in a direction tangential to the drum, wherein the feeding guide and the ejecting guide are disposed near each other in a thickness direction thereof, and the drum is in the same rotational position when feeding of the recording material to the drum is started and when ejection of the recording material from the drum is completed.

Since the feeding guide and the ejecting guide are disposed near to each other in the thickness direction thereof, the rotational position of the drum when the recording material is completely ejected from the drum can be the same as the rotational position where the next recording material begins to be fed to the drum. Therefore, the drum need not be further rotated when replacing the recording materials, thereby improving work efficiency.

A second aspect of the invention is an apparatus for conveying a sheet-like recording material, comprising: leading edge chucks, fixed at an area on a circumferential surface of a drum, for nipping and holding a leading edge of the recording material against the circumferential surface of the drum; a winding device for winding the recording material around the circumferential surface of the drum by rotating the drum in a state in which the leading edge of the recording material conveyed along a flat plate-like feeding guide is held by the leading edge chucks; an unwinding device for unwinding the recording material from the circumferential surface of the drum by rotating the drum in a direction opposite to a direction in which the drum is rotated by the recording material winding device, causing the leading edge chucks to release the leading edge of the recording material, and sending the recording material to a flat plate-like ejecting guide; and a stop control device for stopping the drum so that the leading edge chucks are located in the same position when the recording material is wound around the circumferential surface of the drum by the recording material winding device and when the recording material is unwound from the circumferential surface of the drum by the recording material unwinding device.

By making the rotational position of the drum when the recording material is completely ejected from the drum the same as the rotational position where the next recording material begins to be fed to the drum, the drum need not be further rotated when replacing the recording materials, thereby improving work efficiency.

Further, the leading edge chucks can be fixed at a predetermined position of the drum.

A third aspect of the invention is an apparatus for conveying a sheet-like recording material, comprising: leading edge chucks, fixed at an area on a circumferential surface of a drum, for nipping and holding a leading edge of the recording material against the circumferential surface of the drum; trailing edge chucks, detachably disposed with respect to another area of the circumferential surface of the drum, for nipping and holding a trailing edge of the recording material against the circumferential surface of the drum; a winding device for winding the recording material around the circumferential surface of the drum by rotating the drum in a state in which the leading edge of the recording material conveyed along a flat plate-like feeding guide is held by the leading edge chucks, and, when the recording material has been wound around the circumferential surface of the drum, holding the trailing edge of the recording material with the trailing edge chucks; an unwinding device for unwinding the recording material from the circumferential surface of the drum by rotating the drum in a direction opposite to a direction in which the drum is rotated by the recording material winding device in a state in which the trailing edge of the recording material is released from the trailing edge chucks, causing the leading edge chucks to release the leading edge of the recording material, and sending the recording material to a flat plate-like ejecting guide; and a stop control device for stopping the drum so that the leading edge chucks are located in the same position when the recording material is wound around the circumferential surface of the drum by the recording material winding device and when the recording material is unwound from the circumferential surface of the drum by the recording material unwinding device.

By making the rotational position of the drum when the recording material is completely ejected from the drum the same as the rotational position where the next recording material begins to be fed to the drum, the drum need not be further rotated when replacing the recording materials, thereby improving work efficiency.

Further, the leading edge chucks can be fixed at a predetermined position of the drum, and trailing edge chucks can also be attached and detached at the same position of the drum for holding and releasing the recording material.

In the third aspect, the feeding guide may be disposed nearer to the drum than the ejecting guide is.

When the feeding guide is disposed nearer to the drum than the ejecting guide, the recording material can be fed securely to the drum from the feeding guide and ejected from the drum to the ejecting guide by effectively utilizing the rigidity of the recording material.

Further, in the third aspect, the apparatus may further comprise a squeeze roller disposed in the vicinity of the drum and downstream, in a recording material winding direction, from a position at which the leading edge chucks are located when rotation of the drum is stopped, with the squeeze roller being movable in a radial direction of the drum.

By disposing the squeeze roller movable in the radial direction of the drum, the recording material can be securely wound around the circumferential surface of the drum. Particularly, the leading and trailing edges of the recording material can be guided to appropriate positions when the recording material is wound around the circumferential surface of the drum.

Also, in the third aspect, the drum may be stopped at the same rotational position when winding of the recording material on the drum is started and when unwinding of the recording material from the drum is completed, the leading edge chucks may be positioned on a line extending along a conveyance line from the feeding guide when the drum is stopped, and the squeeze roller may be positioned on a line extending along a conveyance line from a tip of the ejecting guide to the circumferential surface of the drum when the recording material is unwound from the drum.

Since the path in which the recording material is fed to the drum and the path in which the recording material is ejected from the drum are substantially the same, and the drum is stopped at the same rotational position for receiving and for ejecting the recording material, the time required for ejecting and receiving the recording material can be minimized.

DESCRIPTION OF THE PREFERRED EMBODIMENTS

Figure 1:
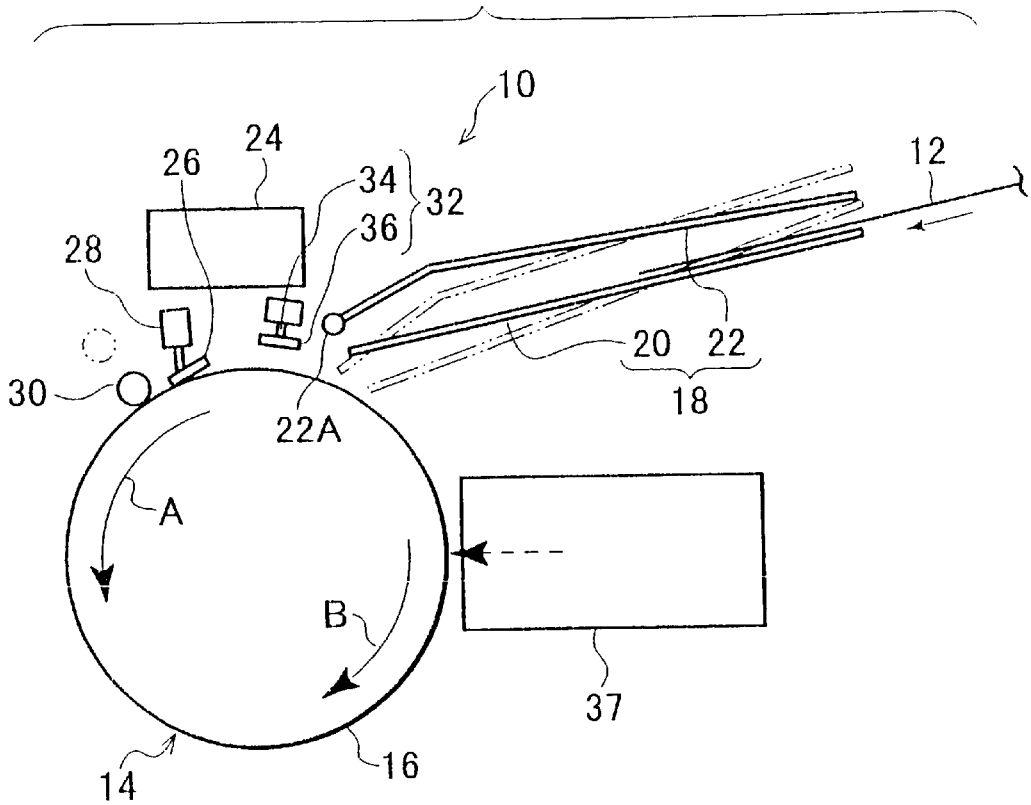
FIG. 1 is a schematic view showing an automatic printing plate exposure apparatus according to an embodiment of the present invention.
Figure 2:
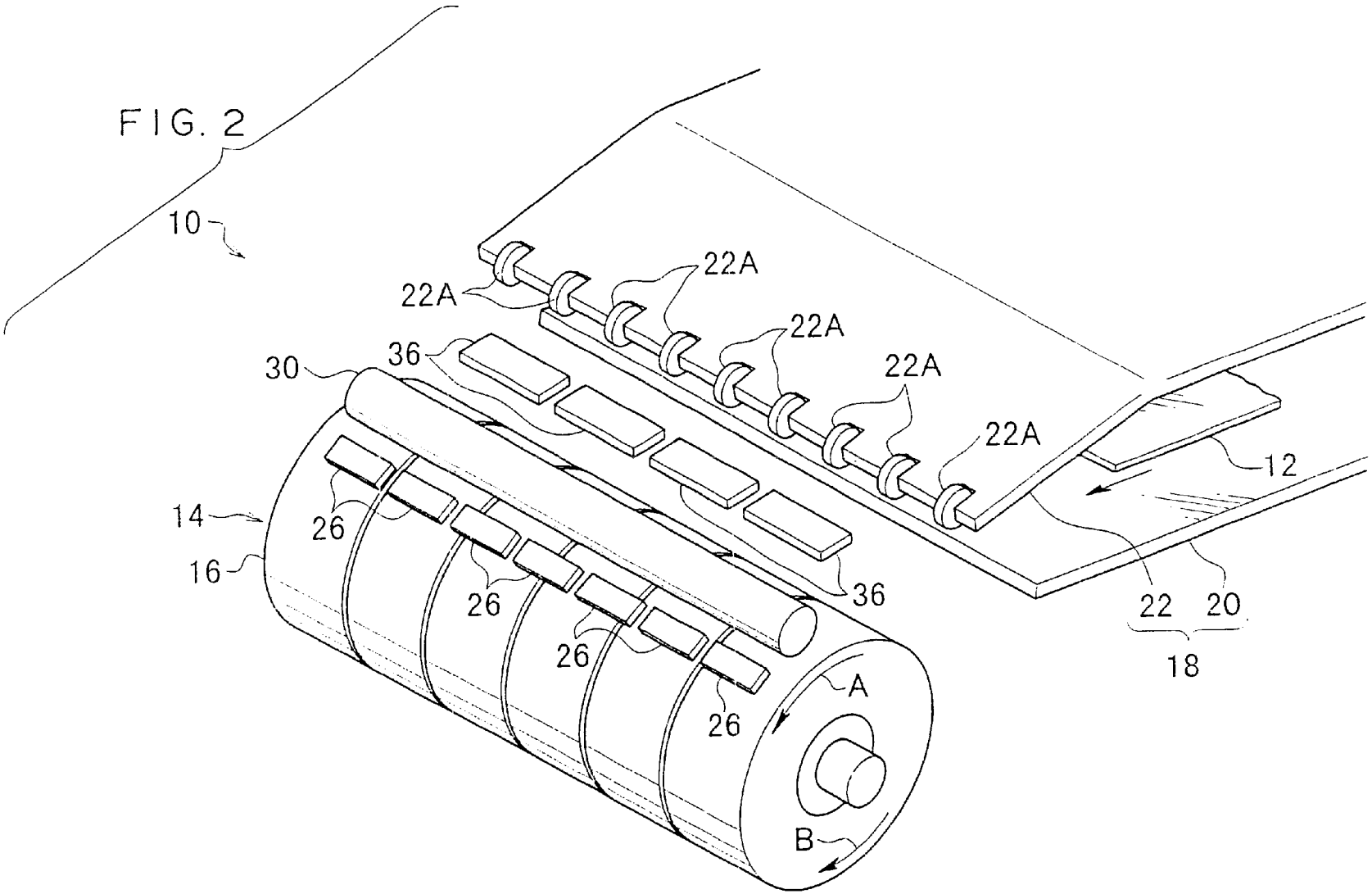
FIG. 2 is a perspective view showing the automatic printing plate exposure apparatus according to the embodiment.

FIGS. 1 and 2 show an automatic printing plate exposure apparatus 10 according to an embodiment of the present invention.

The automatic printing plate exposure apparatus 10 comprises two sections: an exposure section 14 for exposing an image onto an image forming layer of a printing plate precursor 12 by irradiating the image forming layer with a light beam; and a conveyance guide unit 18 for conveying the printing plate precursor 12 toward the exposure section 14. After being exposed in the automatic printing plate exposure apparatus 10, the printing plate precursor 12 is fed to a developing apparatus (not shown) disposed next to the automatic printing plate exposure apparatus 10.

The exposure section 14 includes, as a main component, a rotating drum 16 that has a circumferential surface around which the printing plate precursor 12 is wound and held. The printing plate precursor 12 is guided by the conveyance guide unit 18 and is fed onto the rotating drum 16 along a direction tangential to the rotating drum 16. The conveyance guide unit 18 comprises a feeding guide 20 and a ejecting guide 22.

The feeding guide 20 and the ejecting guide 22 of the conveyance guide unit 18 are disposed so that they have a substantially V-shaped (with a relatively small acute angle) positional relationship relative to each other, and pivot at a predetermined angle about an axis in the vicinity of the center of FIG. 1. With this rotation, the feeding guide 20 or the ejecting guide 22 can be selectively positioned along a direction tangential to the rotating drum 16.

A puncher 24 (see FIG. 1) is disposed in the vicinity of the conveyance guide unit 18. When the feeding guide 20 is positioned to face the puncher 24, the leading edge of the printing plate precursor 12 can be fed into the puncher 24. That is, first, the printing plate precursor 12 is guided by the feeding guide 20 to the puncher 24 so that a registration notch is formed in the leading edge of the printing plate precursor 12. After the notch is formed, the printing plate precursor 12 is carried back to the feeding guide 20. Then, the conveyance guide unit 18 is rotated to bring the printing plate precursor 12 to a position corresponding to a direction tangential to the rotating drum 16.

The feeding guide 20 and the ejecting guide 22 are disposed so as to span between a pair of side plates (not shown) which are parallel to each other.

The relative positional relationship between the feeding guide 20 and the ejecting guide 22 is such that the feeding guide 20 is disposed nearer to the rotating drum the ejecting guide 22 is (the feeding guide 20 is disposed below the ejecting guide 22 in the state shown in FIGS. 1 and 2). The ejecting guide 22 is bent in a substantial L shape, and an end thereof at a side of the rotating drum 16 projects toward the rotating drum 16 further than an end of the feeding guide 20.

Thin rollers 22A are disposed at the end of the ejecting guide 22 near the rotating drum 16.

The rotating drum 16 is rotated by a driving device (not shown) in a direction in which the printing plate precursor 12 is set on the rotating drum 16 and exposed (i.e., the direction of arrow A in FIG. 1) and in a direction in which the printing plate precursor 12 is removed from the rotating drum 16 (i.e., the direction of arrow B in FIG. 1), opposite to the setting/exposing direction. The driving device comprises a drive source such as a motor, and a controller for controlling the drive source to drive and stop. The driving device serves as a recording material winding device, a recording material unwinding device and a stop control device. It should be noted that controlling the stop position of the rotating drum 16 can be easily and accurately performed using a well-known pulse encoder, or the like.

As shown in FIG. 1, leading edge chucks 26 are attached at predetermined positions on the outer circumferential surface of the rotating drum 16 provided in the exposure section 14. When the printing plate precursor 12 is set on the rotating drum 16, rotation of the rotating drum 16 is stopped at a position at which the leading edge chucks 26 face the leading edge of the printing plate precursor 12 being fed by the feeding guide 20 of the conveyance guide unit 18 (the printing plate precursor setting position).

Figure 3:
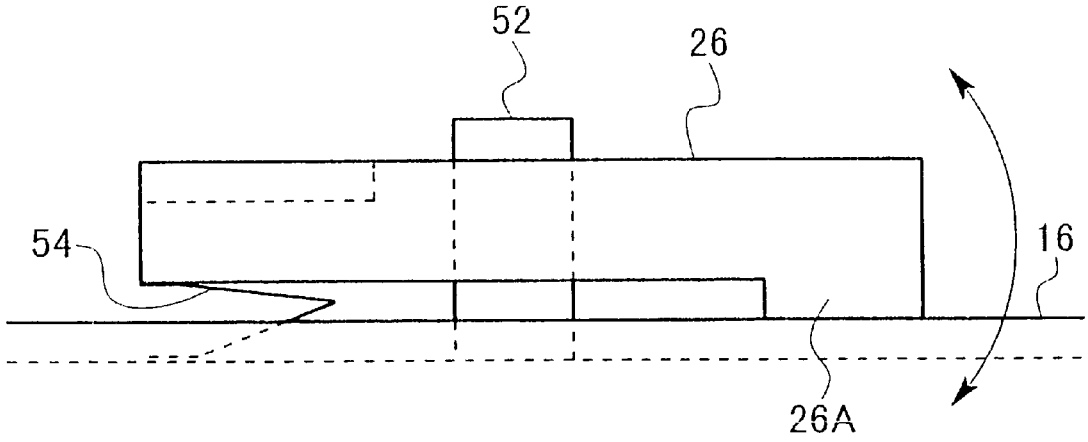
FIG. 3 is a side view of a leading edge chuck.

A chuck opening/closing unit 28 (see FIG. 1) is provided in the exposure section 14 so as to face the leading edge chucks 26 in the printing plate precursor setting position. As shown in FIG. 3, the leading edge chuck 26 includes a nipping portion 26A formed at one of the long sides thereof for pressing the printing plate precursor 12 against the rotating drum 16. Further, the leading edge chuck 26 is supported by a supporting post 52 attached to the rotating drum 16.

The supporting post 52 is positioned, with respect to the circumferential direction of the rotating drum 16, nearer to the long side of the leading edge clamp 50 disposed with the clamping portion 26A than to the other long side of the leading end clamp 50. Using the rotary shaft 52A of the column 52 as a fulcrum, the clamp body 26 can pivot like a seesaw.

A plate spring 54 is interposed, as an urging member, between the circumferential surface of the rotating drum 16 and a portion of the leading edge chuck 26 at a side opposite to the nipping portion 26A with respect to the supporting post 52. The plate spring 54 urges the nipping portion 26A of the leading edge chuck 26 toward the circumferential surface of the rotating drum 16.

In other words, the leading edge of the printing plate precursor 12 fed from the direction tangential to the rotating drum 16 and positioned between the nipping portion 26A and the circumferential surface of the rotating drum 16 can be nipped.

When the chuck opening/closing unit 28 is operated to press one of the ends of each leading edge chucks 26, the nipping portions 26A are moved away from the circumferential surface of the rotating drum 16 against the urging force of the plate springs 54, thereby allowing the printing plate precursor 12 to be interposed between the leading edge chucks 26 and the circumferential surface of the rotating drum 16.

In the exposure section 14, with the leading edge of the printing plate precursor 12 being interposed between the leading edge chucks 26 and the rotating drum 16, the chuck opening/closing unit 28 is returned to its original position to release the leading edge chucks 26. Thus, the leading edge of the printing plate precursor 12 is nipped between the leading edge chucks 26 and the rotating drum 16.

When the printing plate precursor 12 is interposed between the nipping portions 26A and the rotating drum 16, the printing plate precursor 12 is abutted on a registration pin (not shown) and is registered.

In the exposure section 14, when the leading edge of the printing plate precursor 12 is fastened to the rotating drum 16, the rotating drum 16 is rotated in the setting/exposing direction. Thus, the printing plate precursor 12 fed from the feeding guide 20 of the conveyance guide unit 18 is wound around the circumferential surface of the rotating drum 16.

A squeeze roller 30 is disposed in the vicinity of the circumferential surface of the rotating drum 16 downstream in the setting/exposing direction from a position where the leading edge of the printing plate precursor 12 is nipped. The squeeze roller 30 moves toward the rotating drum 16 to press the printing plate precursor 12 being wound around the rotating drum 16 against the rotating drum 16, so that the printing plate precursor 12 closely contacts the rotating drum 16.

Further, a trailing edge chuck attaching/detaching unit 32 (see FIG. 1) is disposed in the vicinity of the rotating drum 16 downstream in the setting/exposing direction from the squeeze roller 30. The trailing edge chuck attaching/detaching unit 32 includes trailing edge chucks 36 attached at tips of shafts 34 that project toward the rotating drum 16.

When the trailing edge of the printing plate precursor 12 wound around the rotating drum 16 faces the trailing edge chuck attaching/detaching unit 32, the shafts 34 are further projected toward the rotating drum 16 to set the trailing edge chucks 36 at predetermined positions on the rotating drum 16. In this manner, the trailing edge of the printing plate precursor 12 is nipped and held between the trailing edge chucks 36 and the rotating drum 16.

As shown in FIG. 1, when both the leading edge and the trailing edge of the printing plate precursor 12 are held on the rotating drum 16, the squeeze roller 30 is moved away from the rotating drum 16. Then, while the rotating drum 16 is rotated at a predetermined high speed, a light beam modulated on the basis of image data is irradiated from a recording head 37 synchronously with the rotation of the rotating drum 16. Thus, the printing plate precursor 12 is scan-exposed on the basis of image data.

When scan-exposure of the printing plate precursor 12 is completed, the rotation of the rotating drum 16 is stopped at a position where the trailing edge chucks 36 holding the trailing edge of the printing plate precursor 12 face the trailing edge chuck attaching/detaching unit 32, and the trailing edge chucks 36 are detached from the rotating drum 16. Thus, the trailing edge of the printing plate precursor 12 is released.

Subsequently, by rotating the rotating drum 16 in the direction in which the printing plate precursor 12 is ejected, the printing plate precursor 12 is ejected the trailing edge first along a direction tangential to the rotating drum 16 onto the ejecting guide 22 of the conveyance guide unit 18. That is, when the trailing edge of the printing plate precursor is released, the trailing edge is slightly lifted from the circumferential surface of the rotating drum 16 due to the rigidity of the printing plate precursor 12 and moves into a position tangential to the rotating drum 16. The ejecting guide 22 is placed in this position. Since the rollers 22A are disposed at the end of the ejecting guide 22, the printing plate precursor 12 is certainly carried onto the ejecting guide 22.

The rotating drum 16 is then further rotated in the reverse direction and the leading edge chucks 26 reach the position where the printing plate precursor 12 has been nipped, rotation of the rotating drum 16 is stopped and the leading edge chucks 26 are released by the chuck opening/closing unit 28. Then, the printing plate precursor 12 is conveyed from the rotating drum 16 to the ejecting guide 22, and the printing plate precursor 12 is conveyed to the developing apparatus for further processing.

The leading edge chucks 26 at this time is in the same manner to receive the next printing plate precursor 12. Therefore, the next printing plate precursor 12 standing by on the feeding guide 20 can be quickly received.

Operation of the embodiment will now be described.

First, the printing plate precursor 12 is placed on the feeding guide 20. At this time, the printing plate precursor 12 may be fed manually or fed by an automatic sheet feeder, or the like.

The printing plate precursor 12 is supported on the feeding guide 20 in an approximate position (in terms of positioning, inclination with respect to the feeding guide 20). In this state, the printing plate precursor 12 is pushed near to a predetermined position for temporary registration.

After the printing plate precursor 12 is temporarily registered, and if the printing plate precursor 12 needs to be punched, the conveyance guide unit 18 is moved (pivoted) so that the feeding guide 20 guides the printing plate precursor 12 to the puncher 24.

At the puncher 24, the leading edge of the printing plate precursor 12 is subjected to predetermined punching. Then, the printing plate precursor 12 is returned to the feeding guide 20 and is temporarily registered.

When exposure is performed, the conveyance guide unit 18 is moved (pivoted) so that feeding guide 20 guides the printing plate precursor 12 to the rotating drum 16. Thus, the printing plate precursor 12 can be fed onto the rotating drum 16 along a direction tangential to the rotating drum 16.

Since the nipping portions 26A are spaced apart from the circumferential surface of the rotating drum 16 by the chuck opening/closing unit 28, the leading edge of the printing plate precursor 12 is fed in the space between the nipping portions 26A and the circumferential surface of the rotating drum 16 and is registered.

Figure 4A:
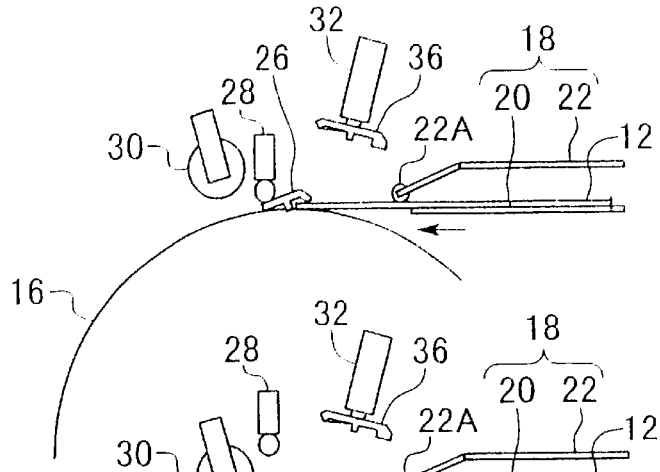
FIGS. 4A to 4E are diagrams for explaining operation according to the embodiment, illustrating a procedure for feeding and ejecting a printing plate precursor to and from a rotating drum, viewed in an axial direction of the drum.

The chuck opening/closing unit 28 is then operated to nip the leading edge of the printing plate precursor 12 between the nipping portions 26A of the leading edge chucks 26 and the circumferential surface of the rotating drum 16 (see FIG. 4A).

Figure 4B:
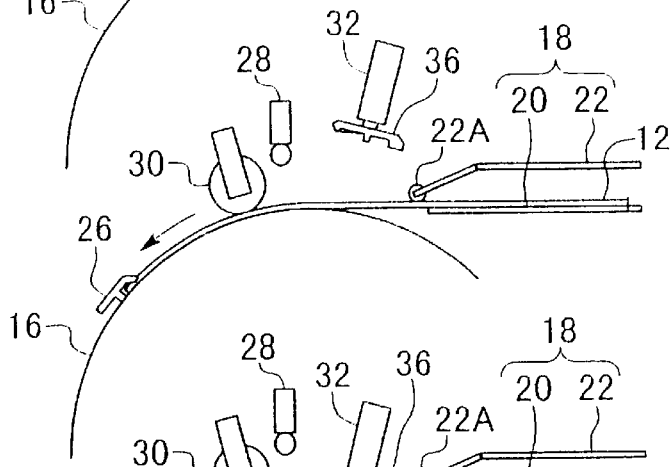

After the leading edge of the printing plate precursor 12 is nipped by the leading edge chucks 26, the rotating drum 16 is rotated to gradually wind the printing plate precursor 12 thereon (see FIG. 4B). At this time, the squeeze roller 30 is moved to be close to the rotating drum 16 to strongly press the printing plate precursor 12 against the rotating drum 16, so that the printing plate precursor 12 can be wound on the circumferential surface of the rotating drum 16 closely.

Figure 4C:
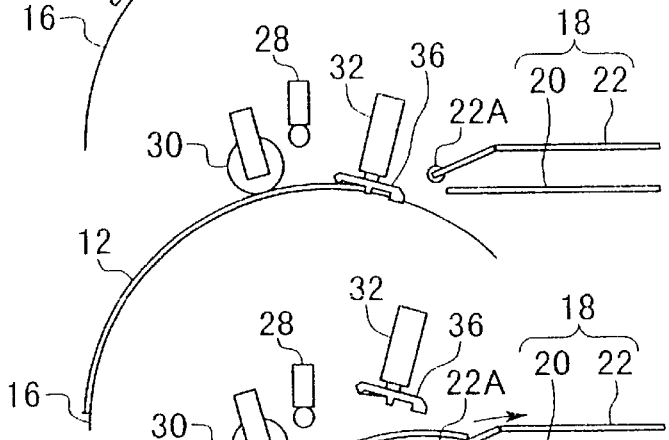

When the trailing edge of the printing plate precursor 12 reaches the circumferential surface of the rotating drum 16, the trailing edge of the printing plate precursor 12 is nipped by the trailing edge chucks 36. In this manner, the printing plate precursor 12 can be closely held on the circumferential surface of the rotating drum 16, and registration of the printing plate precursor 12 for exposure will be completed (see FIG. 4C).

The image data is then read and exposure is started by irradiating a light beam from the recording head 37. The exposure is a so-called scan-exposure which is effected by moving the recording head 37 in the axial direction of the rotating drum 16 (sub-scanning) while the rotating drum 16 is rotated at a high speed (main-scanning).

Figure 4D:
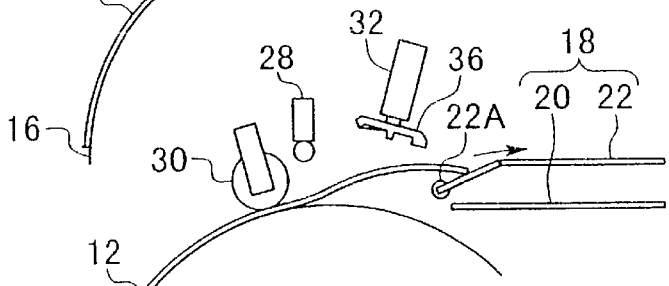

When the exposure is completed, the rotating drum 16 is stopped at a position at which the trailing edge chucks 36 initially nipped the printing plate precursor 12, with the printing plate precursor 12 still being registered. Then, the trailing edge of the printing plate precursor 12 is released from the trailing edge chucks 36 and the trailing edge chucks 36 are moved away from the rotating drum 16 (see FIG. 4D).

Next, the rotating drum 16 is rotated in the direction opposite to the direction in which the printing plate precursor 12 was wound around the rotating drum 16, and the printing plate precursor 12 is ejected along a direction tangential to the rotating drum 16. At this time, since the edge of the printing plate precursor 12 is slightly lifted due to rigidity thereof, the printing plate precursor 12 is sent onto the ejecting guide 22. Further, since the rollers 22A are disposed at the end of the ejecting guide 22 near the rotating drum 16, the printing plate precursor 12 is certainly guided onto the ejecting guide 22.

As the printing plate precursor 12 is sent onto the ejecting guide 22, the printing plate precursor 12 is gradually separated from the rotating drum 16. When the leading edge chucks 26 reach the same position where they initially nipped the printing plate precursor 12, rotation of the rotating drum 16 is stopped.

Figure 4E:
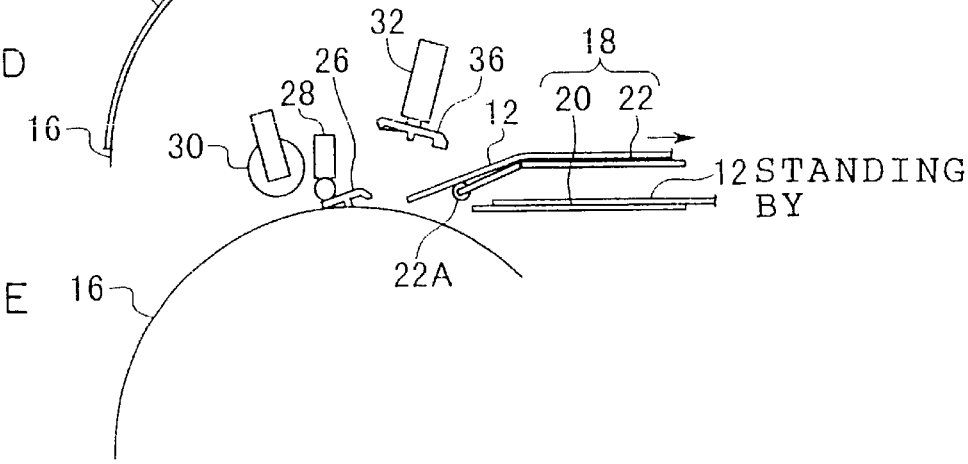
Figure 5A:
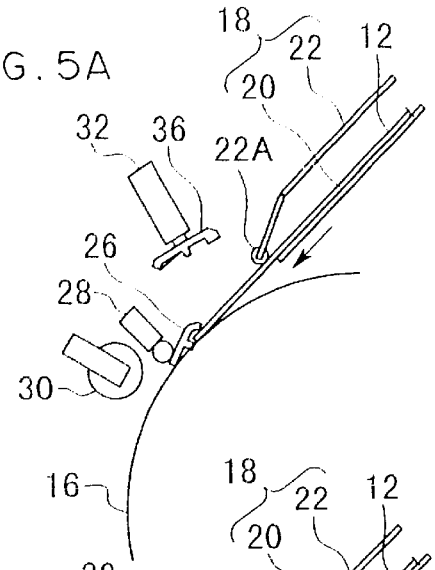
FIGS. 5A to 5E are diagrams for explaining operation according to a modification of the embodiment, illustrating a procedure for feeding and ejecting a printing plate precursor to and from the rotating drum, viewed in the axial direction of the drum.
Figure 5B:
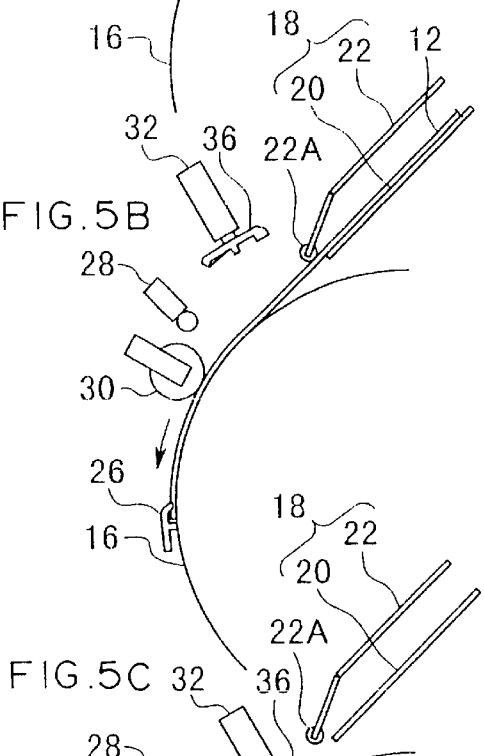
Figure 5C:
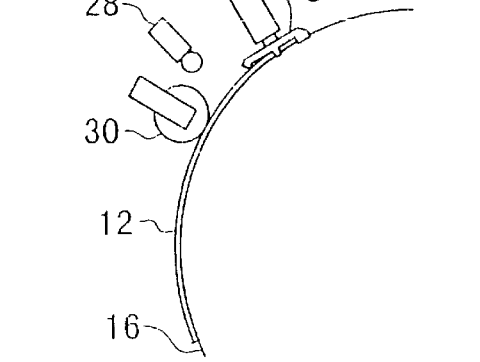
Figure 5D:
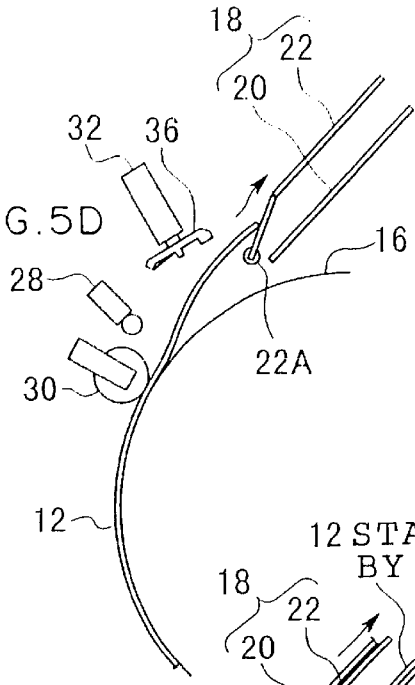
Figure 5E:
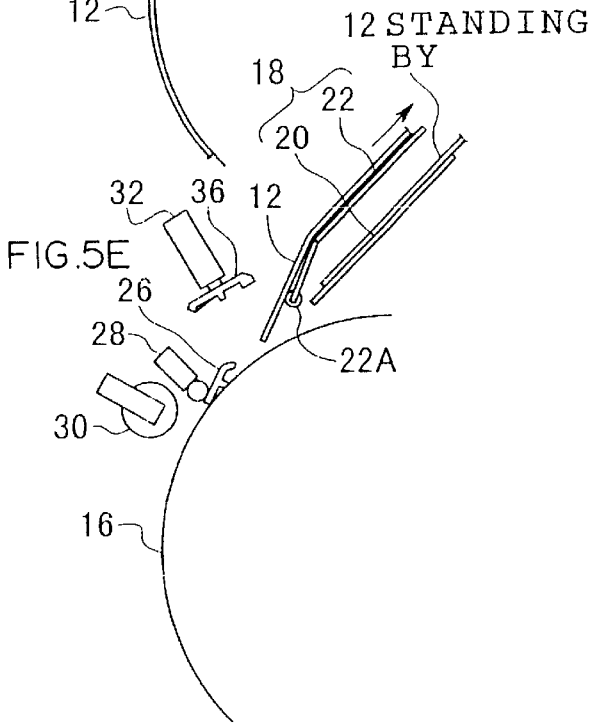

When the rotating drum 16 is stopped, the chuck opening/closing unit 28 is operated to release the printing plate precursor 12 from the leading edge chucks 26 (see FIG. 4E). Then, a driving system of the ejecting guide 22 restarts conveyance of the printing plate precursor 12, and the printing plate precursor 12 is completely conveyed from the rotating drum 16 to the ejecting guide 22. The printing plate precursor 12 ejected from the exposure section is conveyed for further processing to, for example, a developing section to be developed.

The rotational position of the rotating drum 16 when ejection of the printing plate precursor 12 is completed is the same as the position for receiving a new printing plate precursor 12. Therefore, by having the next printing plate precursor 12 stand by on the feeding guide 20, the next printing plate precursor 12 can be quickly received on the rotating drum 16. Thus, there is no waste of time when feeding the printing plate precursor 12, and the printing plate precursors 12 can be efficiently fed in succession to the exposure section 14.

Further, the path to feed the printing plate precursor 12 onto the rotating drum 16 and the path to send out the printing plate precursor 12 from the rotating drum 16 are substantially the same. Therefore, the leading edge chucks 26 and the trailing edge chucks 36 can be attached and detached at the time of feeding and ejecting the printing plate precursor 12 by the same components, and can simplify the structure of the apparatus.

According to the embodiment, by setting a substantially the same rotational position of the rotating drum 16 for feeding and ejecting the printing plate precursor 12, the next printing plate precursor 12, which is standing by on the feeding guide 20 until the ejection of the previous printing plate precursor 12 to the ejecting guide 22 is completed, can be quickly received, thereby improving work efficiency. Further, by disposing the feeding guide 20 and the ejecting guide 22 substantially at the same position (near to each other in the thickness direction thereof), the opening/closing position for the leading edge chucks 26 and attaching/detaching position for the trailing edge chucks 36 respectively become the same at the time of feeding and ejecting the printing plate precursor 12. In a prior art, wherein the feeding guide 20 and the ejecting guide 22 are disposed at different positions, two different opening/closing units were necessary for opening and closing the leading edge chucks 26 for holding and for releasing the printing plate precursor 12. Similarly, two different units were necessary for attaching the trailing edge chucks 36 and for removing the trailing edge chucks 36 from the rotating drum 16. However, in the invention, since the leading edge chucks 26 are opened and closed at the same position and the trailing edge chucks 36 are attached and removed at the same position for holding and releasing the printing plate precursor 12, only one opening/closing unit for the leading edge chucks 26 and only one attaching/detaching unit for trailing edge chucks 36 are necessary. Therefore, the structure of the apparatus can be simplified.

Furthermore, by setting the stop position of the rotating drum 16 as described above, the leading edge chucks 26 are positioned on an extension line of a conveyance line from the feeding guide 20 when the rotating drum 16 is stopped. In addition, the squeeze roller 30 is positioned on an extension line of a conveyance line from the ejecting guide 22 when the printing plate precursor 12 is unwound from the rotating drum 16. This allows minimization of the time required for ejecting and receiving the printing plate precursors 12.

It should be noted that, although the printing plate precursor 12 is fed to and ejected from the rotating drum along a substantially horizontal path (see FIG. 4), the path for feeding and ejecting the printing plate precursor 12 may be inclined as shown in FIG. 5.

Figures 6A, 6B, 6C, 6D, 6E:
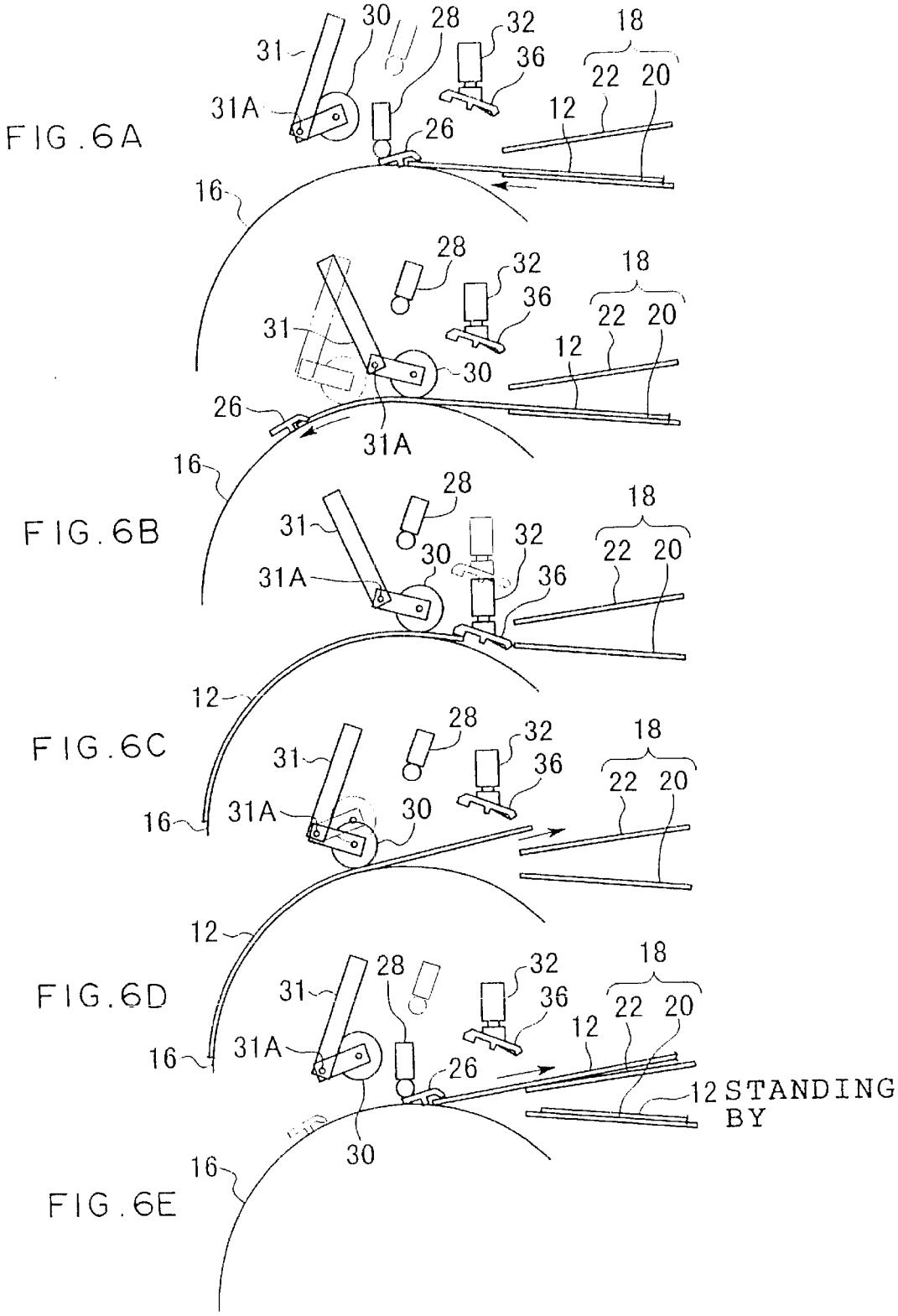
FIGS. 6A to 6E are diagrams for explaining operation according to another modification of the embodiment, illustrating a procedure for feeding and ejecting a printing plate precursor to and from the rotating drum, viewed in the axial direction of the drum.

Moreover, by providing a joint portion 31A to an arm 31 for supporting the squeeze roller 30 as shown in FIG. 6, so that the squeeze roller can move along the circumferential direction of the rotating drum 16, the squeeze roller can also serve to control the height of the edge of the printing plate precursor 12 that lifts from the circumferential surface of the rotating drum 16 when the edge is released at the time of ejection. This allows less precision in the relative position between the feeding guide 20 and the ejecting guide 22 as compared to the precise setting needed to guide the printing plate precursor 12 according only to the natural lift caused by its rigidity.

As described above, the invention has the excellent effect of reducing the number of components and simplifying the complexity of the apparatus structure, while improving work efficiency and reducing the time required for starting feeding of the next recording material after completion of ejection of the previous recording material.

What is claimed is:

1. An apparatus for conveying a sheet-like recording material, comprising:

a feeding device for feeding the sheet-like recording material to a rotating drum from a feeding guide disposed in a direction tangential to the drum; and an ejecting device for ejecting the recording material fed by the feeding device from the drum to an ejecting guide disposed in a direction tangential to the drum, wherein the feeding guide and the ejecting guide are disposed near each other in a thickness direction thereof, and the drum is in the same rotational position when feeding of the recording material to the drum is started and when ejection of the recording material from the drum is completed.

2. A conveying apparatus according to claim 1, wherein the feeding guide is disposed nearer to the drum than the ejecting guide is.

3. A conveying apparatus according to claim 2, further comprising leading edge chucks for nipping and holding, against a circumferential surface of the drum, a leading edge of the recording material conveyed along the feeding guide, wherein the recording material is wound around the circumferential surface of the drum by rotating the drum with the leading edge of the recording material being held by the leading edge chucks.

4. A conveying apparatus according to claim 3, wherein the leading edge chucks are fixed at an area on the circumferential surface of the drum.

5. A conveying apparatus according to claim 4, further comprising a squeeze roller disposed in the vicinity of the drum and downstream, in a recording material winding direction, from a position at which the leading edge chucks are located when rotation of the drum is stopped, with the squeeze roller being movable in a radial direction of the drum.

6. A conveying apparatus according to claim 5, wherein the drum is stopped at the same rotational position when winding of the recording material on the drum is started and when unwinding of the recording material from the drum is completed, the leading edge chucks are positioned on a line extending along a conveyance line from the feeding guide when the drum is stopped, and the squeeze roller is positioned on a line extending along a conveyance line from a tip of the ejecting guide to the circumferential surface of the drum when the recording material is unwound from the drum.

7. A conveying apparatus according to claim 6, further comprising trailing edge chucks, detachably disposed with respect to another area of the circumferential surface of the drum, for nipping and holding a trailing edge of the recording material against the circumferential surface of the drum.

8. A conveying apparatus according to claim 7, wherein the recording material is wound around the circumferential surface of the drum by rotating the drum in a state in which the leading edge of the recording material conveyed along the feeding guide is held by the leading edge chucks, and when the recording material has been wound around the circumferential surface of the drum, the trailing edge of the recording material is held by the trailing edge chucks.

9. An apparatus for conveying a sheet-like recording material, comprising:

leading edge chucks, fixed at an area on a circumferential surface of a drum, for nipping and holding a leading edge of the recording material against the circumferential surface of the drum;

a winding device for winding the recording material around the circumferential surface of the drum by rotating the drum in a state in which the leading edge of the recording material conveyed along a flat plate-like feeding guide is held by the leading edge chucks;

an unwinding device for unwinding the recording material from the circumferential surface of the drum by rotating the drum in a direction opposite to a direction in which the drum is rotated by the recording material winding device, causing the leading edge chucks to release the leading edge of the recording material, and sending the recording material to a flat plate-like ejecting guide; and a stop control device for stopping the drum so that the leading edge chucks are located in the same position when the recording material is wound around the circumferential surface of the drum by the recording material winding device and when the recording material is unwound from the circumferential surface of the drum by the recording material unwinding device.

10. A conveying apparatus according to claim 9, wherein the feeding guide is disposed nearer to the drum than the ejecting guide is.

11. A conveying apparatus according to claim 10, further comprising a squeeze roller disposed in the vicinity of the drum and downstream, in a recording material winding direction, from a position at which the leading edge chucks are located when rotation of the drum is stopped the stop control device, with the squeeze roller being movable in a radial direction of the drum.

12. A conveying apparatus according to claim 11, wherein the drum is stopped at the same rotational position when winding of the recording material on the drum is started and when unwinding of the recording material from the drum is completed, the leading edge chucks are positioned on a line extending along a conveyance line from the feeding guide when the drum is stopped, and the squeeze roller is positioned on a line extending along a conveyance line from a tip of the ejecting guide to the circumferential surface of the drum when the recording material is unwound from the drum.

13. A conveying apparatus according to claim 12, further comprising trailing edge chucks, detachably disposed with respect to another area of the circumferential surface of the drum, for nipping and holding a trailing edge of the recording material against the circumferential surface of the drum.

14. A conveying apparatus according to claim 13, wherein the recording material is wound around the circumferential surface of the drum by rotating the drum in a state in which the leading edge of the recording material conveyed along the feeding guide is held by the leading edge chucks, and when the recording material has been wound around the circumferential surface of the drum, the trailing edge of the recording material is held by the trailing edge chucks.

15. An apparatus for conveying a sheet-like recording material, comprising:

leading edge chucks, fixed at an area on a circumferential surface of a drum, for nipping and holding a leading edge of the recording material against the circumferential surface of the drum;

trailing edge chucks, detachably disposed with respect to another area of the circumferential surface of the drum, for nipping and holding a trailing edge of the recording material against the circumferential surface of the drum;

a winding device for winding the recording material around the circumferential surface of the drum by rotating the drum in a state in which the leading edge of the recording material conveyed along a flat plate-like feeding guide is held by the leading edge chucks, and, when the recording material has been wound around the circumferential surface of the drum, holding the trailing edge of the recording material with the trailing edge chucks;

an unwinding device for unwinding the recording material from the circumferential surface of the drum by rotating the drum in a direction opposite to a direction in which the drum is rotated by the recording material winding device in a state in which the trailing edge of the recording material is released from the trailing edge chucks, causing the leading edge chucks to release the leading edge of the recording material, and sending the recording material to a flat plate-like ejecting guide; and a stop control device for stopping the drum so that the leading edge chucks are located in the same position when the recording material is wound around the circumferential surface of the drum by the recording material winding device and when the recording material is unwound from the circumferential surface of the drum by the recording material unwinding device.

16. A conveying apparatus according to claim 15, wherein the feeding guide is disposed nearer to the drum than the ejecting guide is.

17. A conveying apparatus according to claim 16, further comprising a squeeze roller disposed in the vicinity of the drum and downstream, in a recording material winding direction, from a position at which the leading edge chucks are located when rotation of the drum is stopped, with the squeeze roller being movable in a radial direction of the drum.

18. A conveying apparatus according to claim 17, wherein the drum is stopped at the same rotational position when winding of the recording material on the drum is started and when unwinding of the recording material from the drum is completed, the leading edge chucks are positioned on a line extending along a conveyance line from the feeding guide when the drum is stopped, and the squeeze roller is positioned on a line extending along a conveyance line from a tip of the ejecting guide to the circumferential surface of the drum when the recording material is unwound from the drum.

* * * * *